US005530463A

United States Patent [19]

Nystrom et al.

[11] Patent Number: 5,530,463

[45] Date of Patent: Jun. 25, 1996

[54] INTEGRAL SEAL FOR INK JET PRINTHEADS

[75] Inventors: Peter J. Nystrom, Webster; Fredrick A. Warner, Fairport; David G. Anderson, Ontario, all of N.Y.

[73] Assignee: Xerox Corporation, Stamford, Conn.

[21] Appl. No.: 295,571

[22] Filed: Aug. 25, 1994

[51] Int. Cl.[6] ..... B41J 2/165

[52] U.S. Cl. ..... 347/44; 347/29; 347/42

[58] Field of Search ..... 347/22, 29, 30, 347/31, 32, 33, 44, 42

[56] References Cited

U.S. PATENT DOCUMENTS

| | | | |
|---|---|---|---|
| 4,500,894 | 2/1985 | Kirner | 347/29 |
| 4,567,494 | 1/1986 | Taylor | 347/30 |
| 5,117,244 | 5/1992 | Yu | 347/29 |
| 5,250,962 | 10/1993 | Fisher et al. | 347/30 |

FOREIGN PATENT DOCUMENTS

| | | | |
|---|---|---|---|
| 61-43570 | 3/1986 | Japan | 347/44 |
| 3-184870 | 8/1991 | Japan | 347/29 |
| 3-227646 | 10/1991 | Japan | 347/29 |
| 5-131639 | 5/1993 | Japan | 347/29 |

*Primary Examiner*—John E. Barlow, Jr.
*Attorney, Agent, or Firm*—Daniel J. Krieger

[57] ABSTRACT

An integral seal for priming or maintaining the nozzles or orifices of an ink jet printhead in an ink jet printer. The ink jet printhead includes a plurality of ink ejecting orifices arranged on a surface of the printhead and includes a seal integral with the surface which surrounds the ink ejecting orifices. The seal member is located within a recess formed in the surface and has a contacting surface which can be recessed from the ink ejecting orifices so that cleaning operations of the surface which, for instance, use a wiping blade, are not impeded. A capping member on a maintenance station contacts and slightly compresses the seal member to provide an airtight seal during priming/maintenance operations.

22 Claims, 5 Drawing Sheets

INTEGRAL SEAL FOR INK JET PRINTHEADS

FIELD OF THE INVENTION

This invention relates generally to priming or maintaining the orifices of an ink jet printhead and more particularly to a seal member used in priming/maintenance operations and which is integral to the ink jet printhead.

BACKGROUND OF THE INVENTION

An ink jet printer of the so-called "drop-on-demand" type has at least one printhead from which droplets of ink are directed towards a recording medium. Within the printhead, the ink may be contained in a plurality of channels where power pulses are used to cause the droplets of ink to be expelled, as required, from orifices or nozzles at the ends of the channels.

In a thermal ink jet printer, the power pulses that result in a rapidly expanding gas bubble to eject the ink from the nozzle are usually produced by resistors, each located in a respective one of the channels, which are individually addressable by voltage pulses to heat and vaporize ink in the channels. As voltage is applied across a selected resistor, a vapor bubble grows in that particular channel and ink bulges from the channel orifice. At that stage, the bubble begins to collapse The ink within the channel retracts and separates from the bulging ink which forms a droplet moving in a direction away from the channel orifice and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The nozzles in each printhead are aligned perpendicularly to the line of movement of the carriage and a swath of information is printed on the stationary recording medium as the carriage is moved in one direction. The recording medium is then stepped, perpendicularly to the line of carriage movement, by a distance equal to the width of the printed swath. The carriage is then moved in the reverse direction to print another swath of information.

A pagewidth ink jet printer is described in U.S. Pat. No. 5,192,959. The pagewidth printer includes a full width printhead or printbar which is stationary during printing operations. A sheet of paper is stepped past the printhead and ink is ejected along the entire width of the recording medium for recording images.

It has been recognized that there is a need to maintain the ink ejecting nozzles of an ink jet printhead, for example, by periodically cleaning the orifices when the printhead is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles and also periodically to maintain proper functioning of the nozzles. Maintenance and/or priming stations for the printheads of various types of ink jet printer are described in, for example, U.S. Pat. Nos. 4,855,764; 4,853,717 and 4,746,938 while the removal of gas from the ink reservoir of a printhead during printing is described in U.S. Pat. No. 4,679,059.

It has been found that before the printing operation begins it is necessary to draw ink through the printhead nozzles to thereby fill the channels and nozzles with ink so that printing can begin with accurate placement of the ejected ink upon the medium It has also been found that under certain conditions the ink channels or nozzles will become clogged with debris or with dried ink. In such situations, the printhead must be primed to remove the unwanted material by vacuum priming. In vacuum priming, a priming element is placed against the face of a printhead to cover the nozzles. A vacuum is applied to the nozzles through the priming element and ink is drawn from the printhead, through the priming element, and to a waste container. The priming element is typically made of a flexible and resilient material such as rubber which can collapse under pressure of the applied vacuum.

In U.S. Pat. No. 4,567,494 to Taylor, a nozzle cleaning and priming apparatus for ink jet printers is described. A hollow cylindrical suction cup includes a drain pipe for connection to a suction tube. A second cup made of foam is positioned within the hollow of the cup. The suction tube pulls ink from the printhead and through the foam cup under the application of a vacuum.

U.S. Pat. No. 5,250,962 to Fisher et al. describes a movable priming station for use with an ink jet printer. The movable priming station includes a vacuum port. The vacuum port can be provided with a suction tip which can be oval shaped.

U.S. Pat. No. 5,117,244 to Yu describes a nozzle capping device to cap a thermal ink jet printhead without moving the printhead or a paper transport. A resilient gasket which contains magnetic material is attached to the printhead by a relatively thin flexible boot or sleeve. A steel bar is disposed beneath the paper transport belt. The resilient gasket is either attracted to the steel bar for capping the printhead or attracted to the printhead by an electromagnet for printing operations.

U.S. patent application Ser. No. 08/200,605, filed Mar. 30, 1994, entitled "Ink Jet Printer Priming Element," to Hermanson describes a priming element for priming or maintaining the ink ejecting orifices of an ink jet printhead. The priming element contacts the face of an ink jet printhead and includes support members which prevent the priming element from collapsing during priming/maintenance operations.

U.S. patent application Ser. No. 08/084,095 filed Jul. 1, 1993, entitled "Ink Jet Maintenance Subsystem" to Anderson et al. describes an ink jet maintenance station and an articulating cap assembly to facilitate capping of ink jet printbar nozzles.

SUMMARY OF THE INVENTION

In accordance with one aspect of the present invention, there is provided an ink jet printhead having a plurality of ink ejecting orifices and a surface having arranged thereon the plurality of ink ejecting orifices. A seal member surrounding the ink ejecting orifices is integral with the surface and extends outwardly therefrom.

Pursuant to another aspect of the present invention, there is provided an ink jet printer having an ink jet printhead with a plurality of ink ejecting orifices arranged on a surface, and a seal member surrounding the ink ejecting orifices integral with the surface and extending outwardly therefrom. A maintenance station includes a cap adapted to be aligned with the seal member during a maintenance operation.

Further aspects of the invention include a method for priming an ink jet printhead. The method includes the steps of providing an ink jet printhead having a plurality of ink ejecting orifices arranged on a surface and a seal member attached to the surface surrounding the ink ejecting orifices, providing a maintenance station including a cap, aligning the cap with the seal member, and bringing the cap into contact with the seal member.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
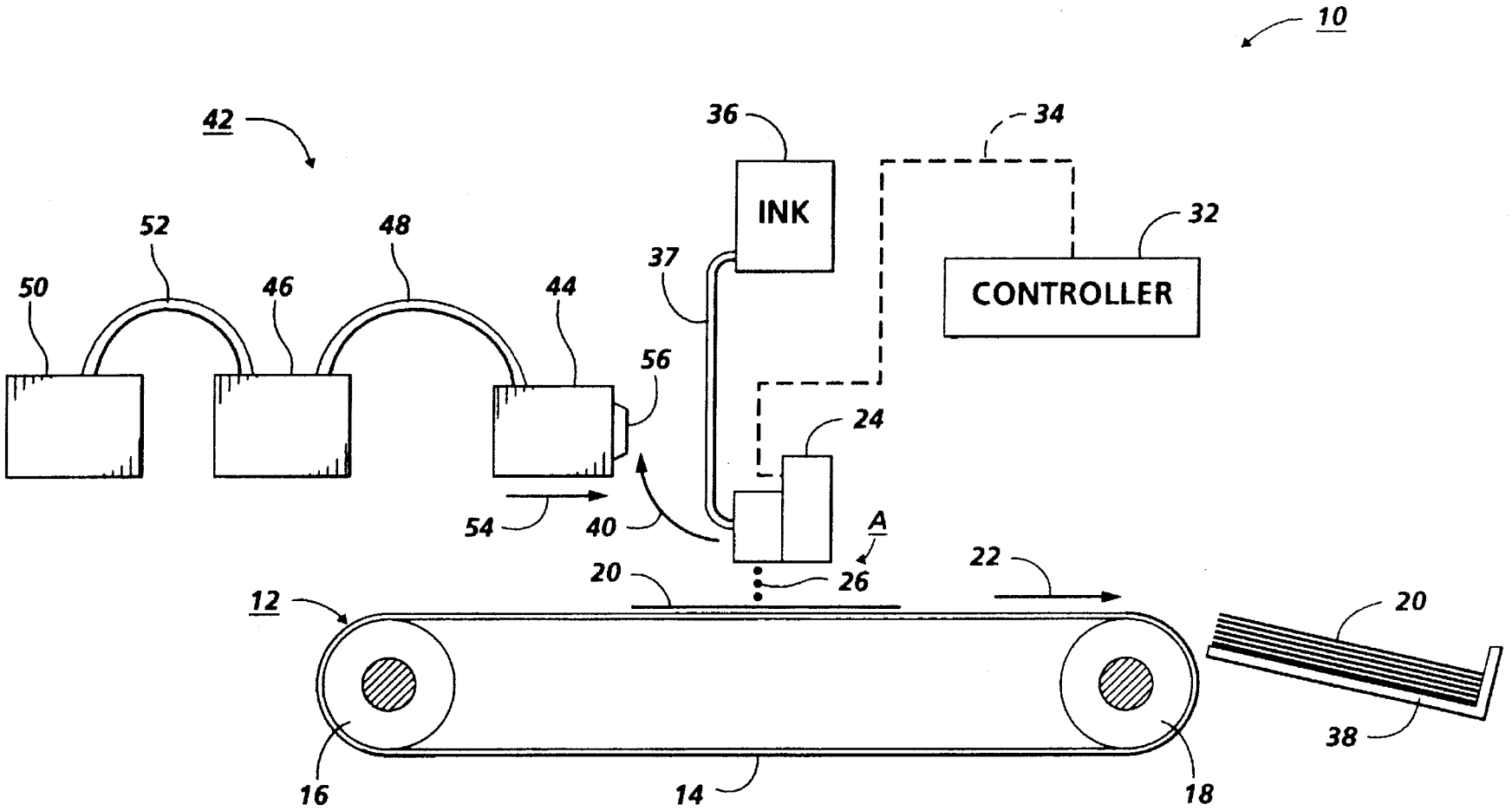
FIG. 1 is a schematic elevational view of an ink jet printer incorporating a capping device and an integral seal of the present invention.

FIG. 1 illustrates a side schematic view of a thermal ink jet printer 10. The ink jet printer 10 employs a transport belt mechanism 12 with belt 14 mounted around rollers 16 and 18, one of which is driven by a motor (not shown). The belt 14 moves a recording medium such as a sheet of paper 20 in the direction of arrow 22 when placed thereon from a typical cassette or paper supply by a sheet feeder, neither of which is shown. Moreover, the paper sheet 20 moves through a printing station generally referred to by reference letter A. While moving through the printing station A, the paper sheet is printed by a full width printhead 24 which ejects a plurality of ink droplets 26 onto the sheet of paper 20 as it passes through the printing station A.

Figure 2:
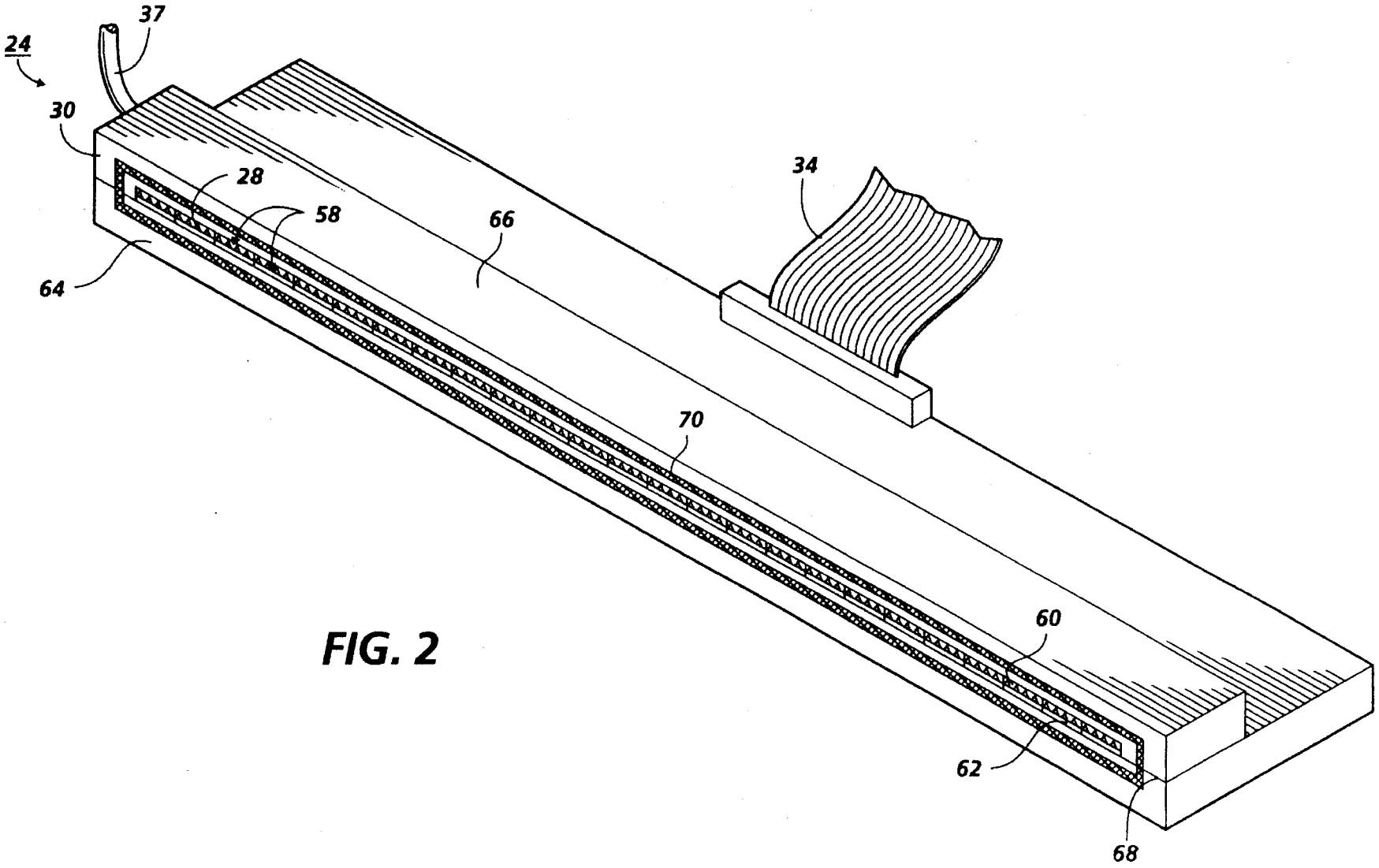
FIG. 2 is a perspective view of a full width printhead incorporating an integral seal.

As illustrated in FIG. 2, the full width printhead 24 includes a plurality of ink ejecting orifices 28 arranged along a face 30 of the ink jet printhead 24. To print information upon the recording sheet 20, a controller 32 (see FIG. 1) coupled to the printhead 24 through a ribbon cable 34, controls selective ejection of ink from each of the individual ink ejecting orifices 28. The controller 32 controls energy pulses that are typically produced by resistors (not shown) each located in a respective one of a channels (also not shown) by individually addressing each resistor with current pulses through the ribbon cable 34 and other electrical circuitry (also not shown) on a printed circuit board attached to the ink jet printhead 24. As vapor bubbles grow in any one of the channels due to the heating of the resistors, ink bulges from the ink ejecting orifices 28 until the current pulse has stopped and the bubble begins to collapse. At this stage, the ink within the channel retracts towards the collapsing bubble and separates from the bulging ink, which forms a droplet moving in a direction away from the orifice and towards the paper sheet. The channel is then refilled by capillary action which, in turn, draws ink from the ink supply 36. This process repeats until the desired information is printed. After printing, the paper sheet 20 leaves the printing station A and is transported by belt 14 to an exit tray 38 where the printed sheets are stacked.

On occasion, either during printing or after printing has been completed, the full width printhead 24 must be serviced either through a priming or a maintenance operation. A priming/maintenance operation begins by moving the printhead in the direction of the arrow 40 which moves the printhead 24 away from the belt 14 and in alignment with a priming/maintenance station 42.

The priming/maintenance station 42 is located outside the printing zone A. At the completion of a printing operation or when necessary, the printhead 24, which is supported by a mechanical support to allow the printhead 24 to move in the direction of the arrow 40, is parked in front of a capping member 44. The capping member 44 is coupled to an ink trap 46 through a first line 48. The ink trap 46 is coupled to a suction pump 50 through a second line 52. The suction pump 50 applies a negative pressure or a vacuum to the capping member 44 through the lines 48, 52, and also through the ink trap 46. The ink trap 46 traps any ink or other debris from the printhead which is drawn by the suction applied through the capping member 44 during a priming or maintenance operation.

When the printhead 24 is aligned with the capping station 44, the capping member 44 is moved towards the printhead 24 in the direction of arrow 54 until a capping element 56 coupled to the capping member 44 contacts the full width printhead 24 for initiation of a priming/maintenance operation. It is also possible to move the printhead 24 into contact with the capping member 44.

A perspective view of the printhead 24 is shown in FIG. 2. As previously described the printhead 24 includes a plurality of ink ejecting orifices 28 arranged along the front face of the printhead. The array of ink ejecting orifices 28 is formed by butting together a plurality of individual subunits 58, each having a channel plate 60 and a heater plate 62 typically formed on silicon substrates. For a more detailed explanation of such printheads and printing thereby refer to U.S. Pat. No. 4,571,599 and U.S. Pat. No. Reissue 32,572, the relevant portions thereof being incorporated into this application. The butted subunits 58 are fixedly located on a mounting substrate 64 preferably made of graphite or carbon. Any metal such as steel or aluminum could also be used. The mounting substrate provides the structural integrity for mounting of the subunits 58 and also provides heat management since the mounting substrate 64 readily conducts and dissipates heat created by the subunits. Above the subunits is placed an ink manifold 66 which is in sealed communication with the individual subunits 58. The ink manifold 66 receives ink over the line 37 from the ink supply 36 (FIG. 1) for providing ink to the individual channels which terminate in the ink ejecting orifices 28. The ink ejecting orifices 28 are coupled to ink channels (not shown) which are present in the individual channel plates 60 which carry ink received from the ink manifold 66.

During printing operations, it is possible that one or more of the ink ejecting orifices 28 can become clogged or fails to function as designed. In addition, because the ink ejecting orifices contain ink which can dry out, it is important that after a printing operation has been completed, the ink ejecting orifices 28 are covered to prevent air from leaking into the ink ejecting orifices thereby causing the ink to dry. Consequently, known priming/maintenance operations typically include moving a capping element forward into contact with the face of a printhead element or full page printbar to thereby surround the ink ejecting orifices. Once the capping element makes a seal with the printhead face, a priming or maintenance operation begins by applying a vacuum to the ink ejecting orifices to either remove ink which has dried and clogs the individual orifices or to prime the ink channels so that printing with the ink can begin. Such priming/maintenance operations, however, suffer from certain problems including the ability of the capping element to provide an air tight seal with the face of the printhead element. Sealing problems can result from the design of the printhead element itself. For instance, as shown in FIG. 2, a seam 68 between the mounting substrate 64 and ink manifold 66 can prevent proper sealing of a capping element to the face of the printhead. Consequently, a need exists for a smooth, contiguous sealing surface on the printhead surrounding the ink ejecting orifices so that sealing problems are prevented.

To overcome these disadvantages and others and to provide an improved seal for priming/maintenance operations, the present invention includes a seal member 70 which is permanently affixed to or integral with the printhead 24. The seal member 70 can also be a replaceable part. The seal member 70 surrounds the ink ejecting orifices 28 and is attached to the face 30 of the full width printhead 24 and extends outwardly therefrom. The seal member 70 is a resilient seal member which can either be a preformed gasket or composed of a material dispensed in a liquid form which cures to an elastic material, such as silicone rubber. Other methods of filling are also possible. The seal member 70 provides a continuous uninterrupted surface for contacting a capping element of a priming/maintenance station. As illustrated in FIG. 2, the seal member 70 extends across the seam 68 and thereby prevents any sealing problems inherent in sealing against the face 30 due to the seam 68.

Figure 3:
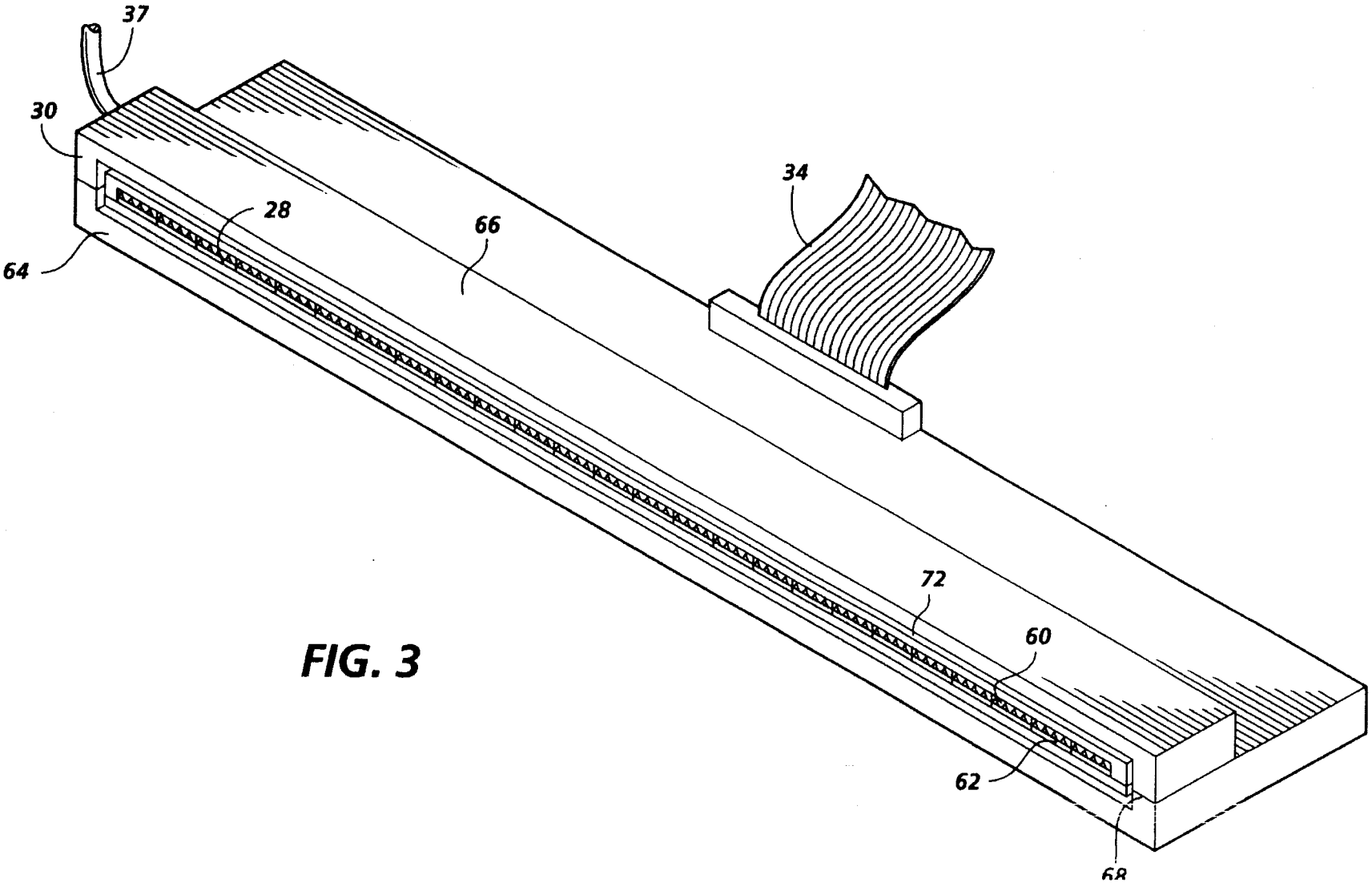
FIG. 3 is a perspective view of a full width printhead having a recess for a seal.

A recess 72, as illustrated in FIG. 3, is formed into the face of the full width printhead 24 to receive the seal member 70 (FIG. 2). The recess 72 can either be rectangularly shaped as illustrated or oval shaped to surround or encircle the ink ejecting orifices 28. It is preferred that the seal member 70 is contained entirely within the recess 72 so that the top surface or contacting surface of the seal member 70 is recessed from or is located behind the ink ejecting orifices 28. By recessing the contacting surface of the seal member 70 maintenance operations such as wiping with a blade or a web of material are not impeded. Recessing the seal member 70 is not necessary, however, and the seal member can be applied to a surface not having a groove. The width of the recess 72 which defines the width of the contacting surface of the seal member 70 can have a dimension of approximately 1 mm. Other dimensions are also possible and are dependent, in part, on the size of the printhead itself, capping forces, the resiliency of materials used, or the size of the capping element which contacts the seal member 70.

Figure 4:
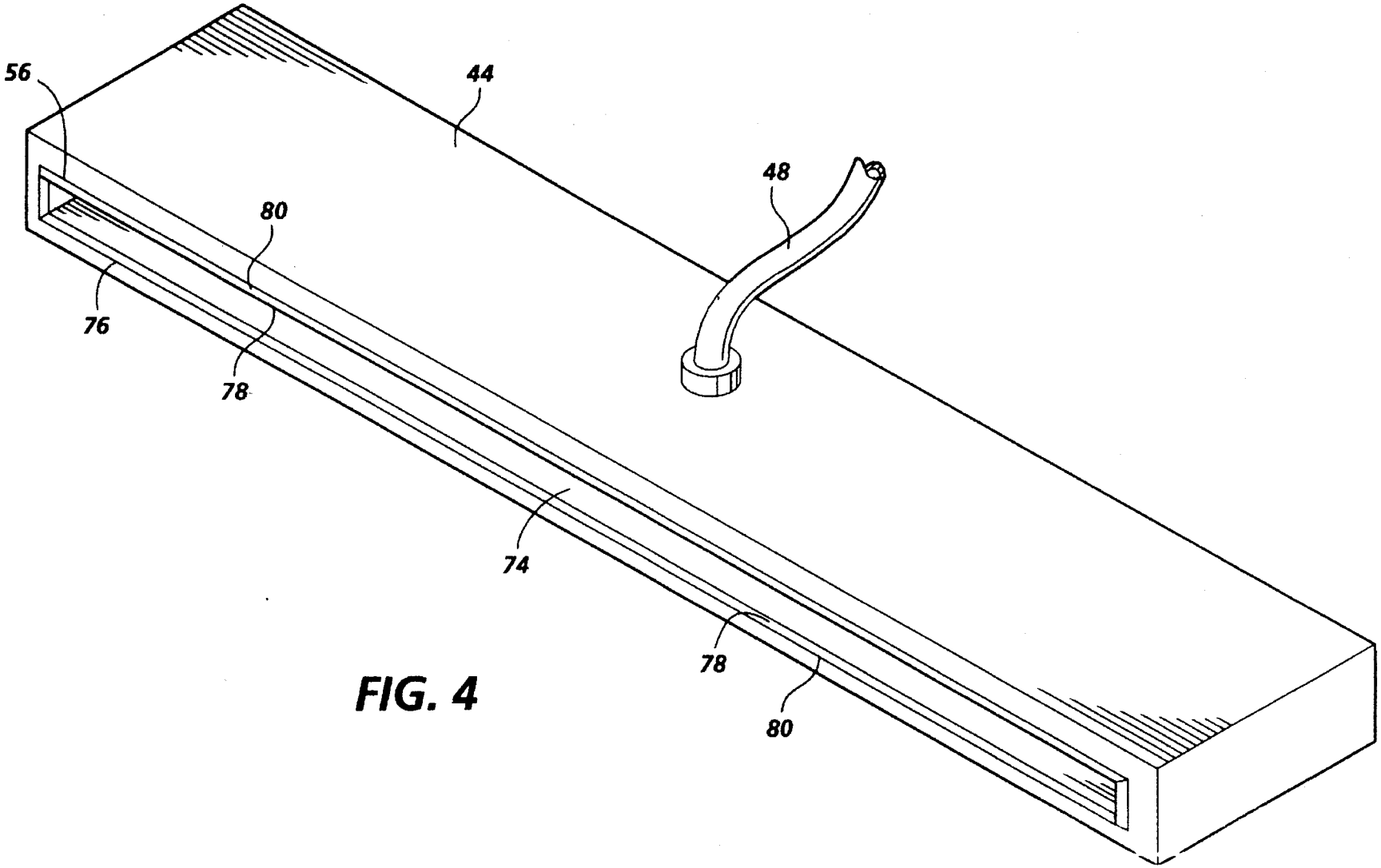
FIG. 4 is a perspective view of a capping member including a capping element.

FIG. 4 illustrates the capping member 44 and the capping element 56. As previously described, the capping member 44 is moved in a direction towards the printhead 24 (or vice versa) until contact is made with the printhead. The capping element 56 has a shape corresponding to the shape of the seal member 70, which is rectangular as shown. The capping element 56 encircles an opening 74 in the capping member 44 so that ink or other debris can be withdrawn from the printhead 24 and collected in the ink trap 46 (FIG. 1) during a priming/maintenance operation through the opening 74. The first line 48 is used to direct a suction or a vacuum caused by the suction pump 50 as previously described.

The capping element 56 is formed of a rigid, non-wearing material such as a hard rubber, a plastic material, or a metal such as aluminum. Not only will the capping element withstand many operations due to its rigid, non-wearing characteristics but the capping element will not collapse under the pressure developed during a priming/maintenance operation. The capping member 56 includes a ridge 76 formed by the intersection of an interior side wall 78 and an exterior side wall 80. The ridge 76 extends around the entire circumference of the capping element 56 and when in contact with the seal member 70 forms an airtight seal therewith. The necessary isolation of the ink ejecting orifices 28 from any outside atmospheric potential is thereby formed and the suction provided by the suction pump 50 through the line 48 can adequately withdraw any ink from the ink ejecting orifices 28 as necessary.

Figure 5:
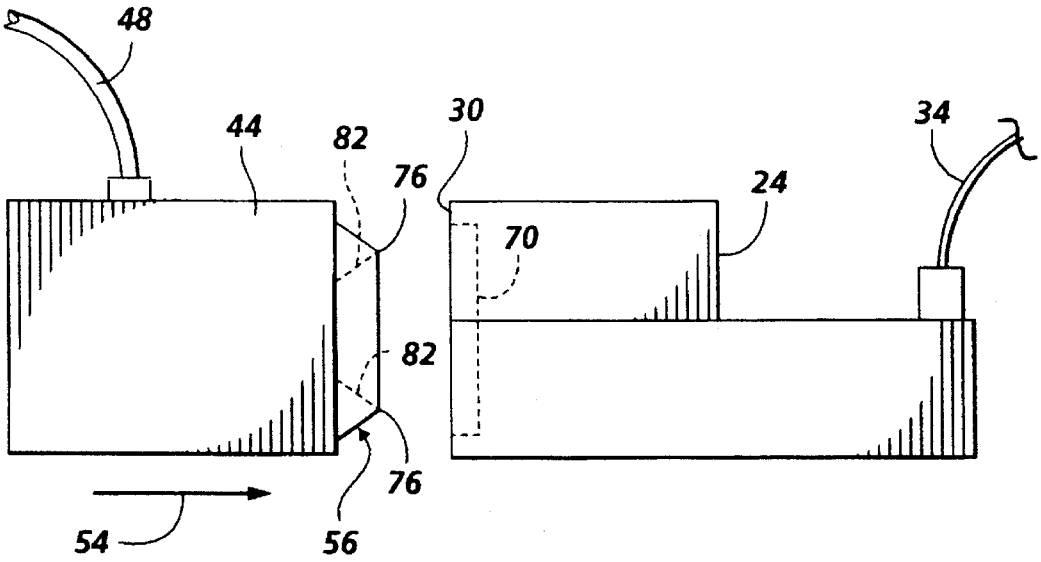
FIG. 5 is an elevational view of a capping member and printhead before a priming/maintenance operation.

FIG. 5 illustrates an elevational view of the printhead 24 in alignment with the capping member 44 to begin a maintenance/priming operation. It is apparent from the illustration that the contacting surface of the seal member 70 does not extend past the face 30 of the printhead. The face 30 is a substantially planar surface without any elements or members extending past the face 30 of the printhead 24. The seal member 70, illustrated in dotted outline, sits beneath the surface of the printhead 24. The capping element 56 extends away from the capping member 44 and includes a dotted outline 82 illustrating the ridge 76 in a side view profile. It is the ridge 76 which contacts the seal member 70 during the priming/maintenance operation.

Once the capping element 56 is properly aligned with the seal member 70, the capping element 56 is brought into contact with the contacting surface of the seal member 70 by typically moving the capping member 54 in the direction of the arrow 54.

Figure 6:
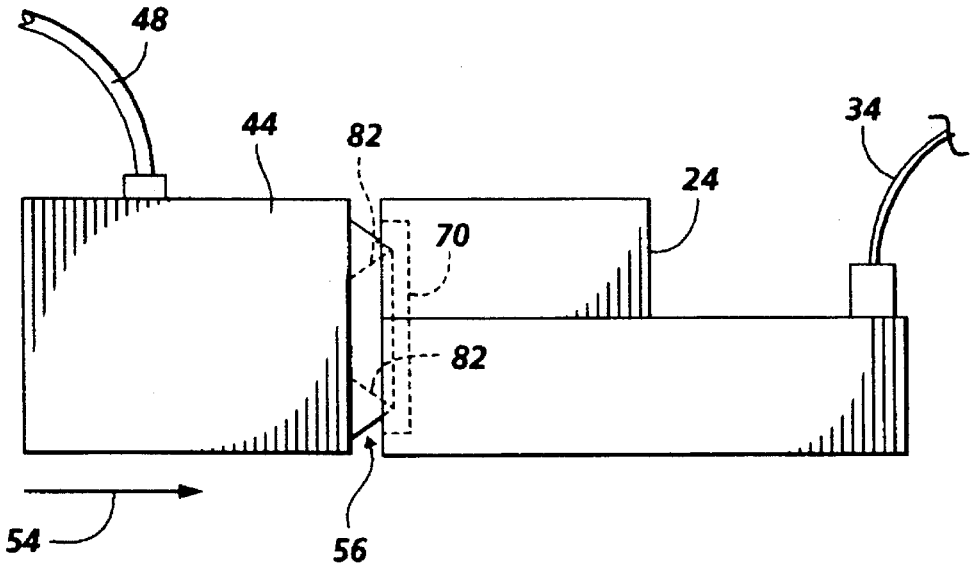
FIG. 6 is an elevational view of a capping member and printhead during a priming/maintenance operation.

The capping member 44 is moved in direction 54 to cause the capping element 56 to contact the seal member 70, as illustrated in FIG. 6. A seal is made between the capping element 56 and the seal member 70 by causing the capping element 56 to compress the seal member 70 a sufficient amount to thereby form the necessary seal between the two elements. It is desirable that the ridge 76 be narrow thereby lowering the force necessary to create an adequate seal between the capping element and the seal member. By forming a fairly narrow ridge, the surface area that is compressed on the seal member 70 is also reduced and consequently the pressure or force between the capping member 44 and the printhead element 24 necessary to achieve a proper seal is also reduced. The combination of the reduced pressure necessary to create an adequate seal and the minimization of contact area by selecting a narrow ridge also serves to minimize the cohesive forces which occur between the printhead element and the capping element during priming/maintenance operations.

Once a priming/maintenance operation is complete, the capping element is moved away from the seal element thereby decompressing the seal element. The shape of the ridge and the elastic seal member reduce the suction which is developed when decapping or removing the capping element from contact with the seal member. This reduction in the amount of suction developed during decapping operations decreases the likelihood of pulling ink out of the ink ejecting orifices 28 during the decapping operation thereby preventing misfiring of the ink ejecting orifices during the start of a printing operation. In the alternative, however, a valve structure incorporated within the capping member 44, for releasing the built-up pressure could be used to reduce the pressure inherent in such a design before decapping and thereby eliminating the possibility of pulling ink from the ink ejecting orifices.

In recapitulation, there has been described an integral seal for a full width ink jet printhead. The integral seal for ink jet printheads which has a contacting surface disposed beneath the face of the printhead itself does not interfere with wiping operations which include using a web or a blade of material. In addition, since the printhead includes the resilient seal member, a new seal member is always provided when a new printhead is placed in an ink jet printer. Likewise, any problems associated with wear of the seal member are avoided since it is anticipated that the printhead unit itself will be replaced before the seal member is substantially degraded.

It is, therefore, apparent that there has been provided in accordance with the present invention, an integral seal member for an ink jet printhead that fully satisfies the aims and advantages hereinbefore set forth. While this invention has been described in conjunction with a specific embodiment thereof, it is evident that many alternatives, modifications and variations will be apparent to those skilled in the art. For instance, the present invention is quite suitable for scanning type printhead customer replaceable units which contain an ink supply. Since the printhead cartridge includes the resilient seal member, maintenance problems are reduced since the seal member is disposed of when the printhead cartridge is replaced. It is also possible to use the present invention with any printhead which dispenses liquid ink or other media of a volatile nature. It is not limited to thermal ink jet devices but includes all liquid ink printhead devices, including piezoelectric devices. Accordingly, it is intended to embrace all such alternatives, modifications, and variations that fall within the spirit and broad scope of the appended claims.

What is claimed is:

1. An ink jet printhead for printing an image, comprising:

a plurality of ink ejecting orifices;

a printhead surface having arranged thereon said plurality of ink ejecting orifices and defining a recess; and a seal member, disposed in the recess, extending no further than said printhead surface, surrounding said ink ejecting orifices, said seal member including a contacting surface being exposed during printing of the image.

2. The ink jet printhead of claim 1, wherein said contacting surface is recessed from said ink ejecting orifices.

3. The ink jet printhead of claim 2, wherein the recess is a groove encircling said ink ejecting orifices.

4. The ink jet printhead of claim 3, wherein said seal member comprises a deformable material.

5. The ink jet printhead of claim 4, wherein said seal member comprises a preformed resilient gasket.

6. The ink jet printhead of claim 3, wherein said seal member comprises a material dispensed in liquid form into the groove curing to an elastic material.

7. A ink jet printer for printing an image, comprising:

an ink jet printhead having a plurality of ink ejecting orifices, a printhead surface having arranged thereon said plurality of ink ejecting orifices and defining a recess, and a seal member, disposed in the recess, extending no further than said planar surface, said seal member including a contacting surface being exposed during printing of the image surrounding said ink ejecting orifices; and a maintenance station including a cap adapted to be aligned with said seal member during a maintenance operation.

8. An ink jet printer comprising:

an ink jet printhead having a plurality of ink ejecting orifices, a surface having arranged thereon said plurality of ink ejecting orifices and a seal member surrounding said ink ejecting orifices integral with said surface and extending outwardly therefrom, said surface defining a recess, said seal member being disposed in the recess, said seal member including a contacting surface, said contacting surface being recessed from said ink ejecting orifices; and a maintenance station including a cap adapted to be aligned with said seal member during a maintenance operation.

9. The ink jet printer of claim 8, wherein the recess is a groove encircling said ink ejecting orifices.

10. The ink jet printer of claim 9, wherein said seal member comprises a deformable material.

11. The ink jet printer of claim 10, wherein said seal member comprises a preformed gasket.

12. The ink jet printer of claim 9, wherein said seal member comprises a material dispensed in liquid form into the groove curing to an elastic material.

13. The ink jet printer of claim 12, wherein said cap includes a contacting portion to engage said contacting surface of said seal member.

14. The ink jet printer of claim 13, wherein said cap comprises a substantially rigid material.

15. The ink jet printer of claim 14, wherein said contacting portion includes a ridge.

16. A method for priming an ink jet printhead, comprising:

providing an ink jet printhead having a plurality of ink ejecting orifices arranged on a surface and a seal member surrounding the ink ejecting orifices integral with said surface and extending outwardly therefrom;

providing a maintenance station including a cap;

aligning the cap with the seal member;

bringing the cap into contact with the seal member, said bringing step further including the step of compressing the seal member with the cap after said bringing step; and priming the ink jet printhead.

17. The method of claim 16, wherein said compressing step includes moving a portion of the cap behind the ink ejecting orifices.

18. The method of claim 17, further including the step of decompressing the seal member.

19. The method of claim 18, wherein said first providing step includes disposing the seal member in a recess in the surface.

20. The method of claim 19, wherein said bringing step further includes the step of compressing the seal member with said cap after said bringing step.

21. The method of claim 20, wherein said compressing step includes moving a portion of the cap behind the ink ejecting orifices.

22. The method of claim 21, further including the step of decompressing the seal member.

* * * * *